United States Patent [19]

Shaw

[11] Patent Number: 4,519,979

[45] Date of Patent: May 28, 1985

[54] NICKEL-CHROMIUM-COBALT BASE ALLOYS AND CASTINGS THEREOF

[75] Inventor: Stuart W. K. Shaw, Sutton Coldfield, England

[73] Assignee: INCO Europe Limited, London, England

[21] Appl. No.: 501,612

[22] Filed: Jun. 6, 1983

[51] Int. Cl.[3] ..... C22C 19/05
[52] U.S. Cl. ..... 420/448; 148/404
[58] Field of Search ..... 420/448, 449, 450; 148/404, 410, 428

[56] References Cited

U.S. PATENT DOCUMENTS 4,039,330 8/1977 Shaw ..... 420/448

*Primary Examiner*—R. Dean
*Attorney, Agent, or Firm*—Francis J. Mulligan, Jr.; Raymond J. Kenny

[57] ABSTRACT

A nickel-chromium-cobalt base alloy having an improved combination of creep-rupture strength at elevated temperatures, resistance to corrosion in sulfur and chloride-containing environments, structural stability at elevated temperatures and good castability.

Articles and parts cast from the alloy, in particular directionally-solidified castings, are suitable for use in gas turbine engines, e.g., for stationary land-based and marine propulsion turbines.

5 Claims, 1 Drawing Figure

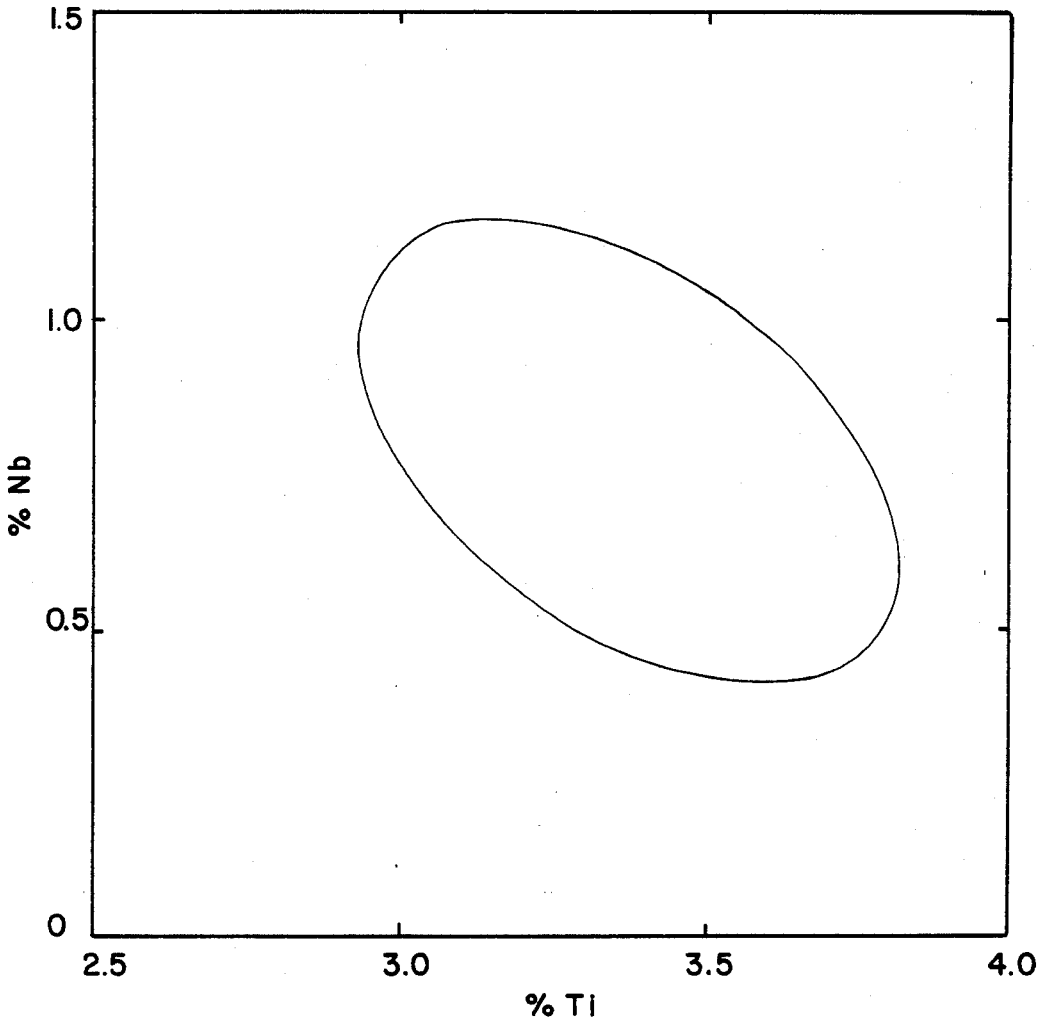
1.5
1.0
0.5
0
% Nb
2.5
3.0
3.5
4.0
% Ti

NICKEL-CHROMIUM-COBALT BASE ALLOYS AND CASTINGS THEREOF

TECHNICAL FIELD

This invention relates to improved castable nickel chromium-cobalt base alloys and to castings of these alloys.

BACKGROUND OF THE INVENTION

Nickel-chromium and nickel-chromium-cobalt base alloys containing titanium and aluminum develop, on suitable heat-treatment, a high level of creep-rupture strength at high temperatures and are widely used in applications giving rise to high stress at elevated temperatures, such as gas turbine engine rotor blades and vanes. However, the need to use impure fuels such as diesel oil in land-based and marine propulsion turbines gives rise to sulfidation attack. Operation in marine and other chloride-containing environments also results in severe corrosion problems.

Many gas turbine and other components, particularly those of complex design, are best produced by precision casting, and there is thus a need for an alloy that can be cast to shape and possesses, in the cast form, a high level of strength at elevated temperatures in conjunction with good resistance to corrosion in sulfur- and chloride-containing environments and structural stability, i.e., freedom from sigma-phase formation, after extended service at elevated temperatures.

In U.S. Pat. No. 4,039,330 are described alloys that exhibit this combination of properties and contain from 0.02 to 0.25% carbon, from 20 to 25% chromum, from 5 to 25% cobalt, one or both of molybdenum (up to 3.5%) and tungsten (up to 5%) in such amounts that the value of %W+0.5 (%Mo) is from 0.5 to 5%, from 1.7 to 5% titanium and from 1 to 4% aluminum, with the provisos that the sum of the aluminum and titanium contents is from 4 to 7% and the ratio of titanium to aluminum is from 0.75:1 to 4:1, from 0.5 to 3tantalum, from 0 to 3% niobium, from 0.005 to 1.0% zirconium and from 0 to 1.99% hafnium, with the proviso that the value of %Zr+0.5 (%Hf) is from 0.01 to 1%, from 0.001 to 0.05% boron, and from 0 to 0.2% in total of yttrium or lanthanum or both, the balance, apart from impurities, being nickel in an amount of at least 30%. All the percentages and ratios in this composition range and elsewhere in the present specification, are by weight.

One alloy according to this specification is available commercially under the designation IN-939, with the nominal composition:

C 0.15; Cr 22.5%; Co 19%; W 2%; Ti 3.7%; Al 1.9%; Ta 1.4%; Nb 1.0%; Zr 0.1%; B 0.01%; Ni balance.

After heat-treatment consisting of solution-heating for 4 hours at 1150° C., air-cooling and then aging for 16 hours at 850° C., equiaxed castings of alloy IN-939 (made by vacuum melting followed by remelting and casting under vacuum) typically have a creep-rupture life at 870° C. under a stress of 185N/mm$^2$ (19 kgf/mm$^2$) of about 1250 hours, which corresponds to about 850 hours at the same temperature under the higher stress of 200N/mm$^2$. When the alloys are directionally-solidified to produce a columnar crystal structure the creep-rupture life, when stressed along the major crystal axis, is increased to about 1370 hours at 870° C. and 200N/mm$^2$.

In U.S. Pat. No. 4,039,330 creep-rupture test results are also given for two alloy compositions with and without additions of hafnium. Comparison of the results for the hafnium-containing and hafnium-free alloys showed that the presence of 0.75% hafnium had little or no effect on the creep-rupture life, though it produced some increase in the elongation at rupture.

OBJECTS OF THE INVENTION AND BRIEF DESCRIPTION OF THE DRAWING

The principal objects of the present invention are to provide alloys, and castings thereof, particularly directionally-solidified castings, having improved creep-rupture life at elevated temperatures.

Other objects and advantages will become apparent from the following description, taken in conjunction with the drawing, in which the sole FIGURE is a graph in which niobium content of alloys are plotted as ordinates and titanium contents as abscissae to define an area of alloy composition according to the invention.

SUMMARY OF THE INVENTION

The invention is based on the discovery that by means of a special correlation of the contents of titanium, aluminum, niobium and hafnium in a range of alloy compositions that also contain nickel, chromium, cobalt, tungsten (with or without molybdenum), tantalum, carbon, boron and zirconium, the creep-rupture life of castings of the alloys, particularly in the directionally-solidified form, can be further substantially increased.

DETAILED DESCRIPTION OF THE INVENTION

The range of composition within which this improvement is obtained is set forth in Table I.

TABLE I

| Constituent | Range (wt %) |
|---|---|
| Cr | 20–23 |
| Co | 17–23 |
| W | 1–2.5 |
| Mo | 0–0.5 |
| Nb | 0.4–1.2 |
| Ta | 0.6–1.4 |
| Ti | 2.95–3.85 |
| Al | 1.6–2.8 |
| Hf | 0.3–1.3 |
| Zr | 0.005–1 |
| B | 0.001–0.05 |
| C | 0.01–0.25 |
| Ni | Bal* |

*Balance includes impurities.

The alloys according to the invention are broadly those having compositions within the range set forth in Table I and in which the contents of niobium, hafnium, titanium and aluminum (in wt.% of the alloy) are so correlated that they satisfy the expression:

$$28327\ Nb + 804\ Hf + 36956\ Ti + 115057\ Al - 6676\ Nb^2 - 564\ Hf^2 - 4847\ Ti^2 - 54349\ Al^2 + 8392\ Al^3 - 5255\ (Nb \times Ti) \geqq 153123 \text{ and preferably } \geqq 153223$$

The value of this expression is referred to herein as the Correlation Factor.

Advantageously the carbon content of the alloys of the invention is about 0.05 to about 0.20%, the zirconium content is about 0.005 to about 0.15% and the boron content is about 0.002 to about 0.02%.

The alloys of the invention, in the directionally-solidified form and after solution-heating and aging, may exhibit creep-rupture lives in excess of 1600 hours, e.g., of at least 2500 or 2600 hours or more, at 200N/mm$^2$ and 870° C. when stressed along the major crystal axis.

The effect of the required correlation with hafnium and aluminum in restricting the contents of titanium and niobium is shown for alloys that contain 0.7% hafnium and 2% aluminum in the accompanying drawing, in which the content of niobium is plotted as ordinates and that of titanium as abscissae, and the alloys having compositions corresponding to points in the area defined by the ellipse have a Correlation Factor of at least 153 223.

Apart from the constituents set forth in the Table, impurities that may be present include small amounts of silicon, manganese and iron, though these should be kept as low as possible. The silicon content should not exceed 1%, and preferably is less than 0.5%, most preferably not more than 0.2%, as it impairs the corrosion resistance. Manganese should be less than 1% and is preferably not more than 0.2%. The iron content may be as much as 3%, but is preferably not more than 0.5%. Traces of nitrogen and sulfur may also be present, but preferably not more than 0.005% each.

One example of an alloy according to the invention has the nominal composition:

Cr 22%; Co 19%; W 2%; Ta 1.1%; Ti 3.4%; Nb 0.8%; Hf 0.7%; Al 2%; C 0.15%; Zr 0.1%; B 0.01%; Balance Ni and impurities.

The alloys should be prepared by vacuum melting and then subjected to vacuum refining, e.g., by holding under vacuum for from 15 minutes to 1 hour. In the production of castings by remelting the alloys, the cast stick or other initial form should be remelted and cast under vacuum.

The alloys have good castability and are particularly suitable for the production of cast shaped articles and parts. To obtain the best properties, in particular, creep-rupture life, resistance to thermal fatigue, and ductility, the castings are preferably directionally solidified to obtain a columnar crystal structure, but the invention specifically includes shaped castings made from the alloys both with substantially equiaxed and with columnar crystal structures. Such castings include parts of gas turbine engines, especially stationary landbased and marine propulsion turbines, for example gas turbine rotor or stator blades, both with and without cooling passages, and integrally bladed turbine rotor discs. Directional solidification may be effected in any manner conventionally employed for high-temperature alloys.

To develop the desired creep rupture properties, the castings must be subjected to a heat-treatment comprising solution-heating and aging. The solution-heating preferably consists in heating for from 2 to 24 hours. The aging may be effected in a single stage, or in two stages, e.g., from 2 to 12 hours at 1020°–870° C. and then from 6 to 48 hours at 860°–650° C. Suitable heat treatments are:

4 hours/1160° C.+16 hours/843° C. (single aging)

8 hours/1160° C.+4 hours/900° C.+16 hours/760° C. (double aging).

After each stage of heat-treatment the alloy may be air-cooled (AC).

The importance of maintaining the alloy composition and Correlation Factor within the range according to the invention is shown by tests performed in Table II below. Of these, Alloys 1 to 4 are in accordance with the invention, while Alloys A to E are not. All the alloys were melted and cast in vacuum and cast using a hot refractory or exothermic mold with a chill base to produce castings having a columnar crystal structure. The castings were heat treated as indicated in Table III, and standard creep-rupture test pieces were machined from them so that the whole of the test piece had a columnar crystal structure extending axially of the test piece.

The test pieces were then subjected to creep-rupture tests under a stress of 200N/mm$^2$ at 870° C., with the results set out in Table II, which also includes the Correlation Factor calculated from the alloy compositions.

The test results show that the creep-rupture lives of Alloys 1 to 4 according to the invention are substantially better than those of Alloys A to E, of which Alloy E is IN-939.

TABLE II

| Alloy No. | COMPOSITION (WEIGHT %) | | | | | | | | | | |
|---|---|---|---|---|---|---|---|---|---|---|---|
| | C | Cr | Co | W | Nb | Ta | Hf | Ti | Al | Zr | B |
| 1 | 0.14 | 22.2 | 19.0 | 2.0 | 0.8 | 1.1 | 0.7 | 3.5 | 2.3 | 0.09 | 0.007 |
| 2 | 0.16 | 22.0 | 18.9 | 2.0 | 0.8 | 1.1 | 0.8 | 3.5 | 2.0 | 0.09 | 0.006 |
| 3 | 0.15 | 22.3 | 18.9 | 2.1 | 0.9 | 1.1 | 0.7 | 3.5 | 1.9 | 0.11 | 0.009 |
| 4 | 0.11 | 20.1 | 18.9 | 1.9 | 0.57 | 1.15 | 0.48 | 3.78 | 2.78 | 0.12 | 0.010 |
| A | 0.16 | 22.1 | 18.7 | 1.8 | 1.3 | 1.1 | 1.0 | 3.0 | 2.2 | 0.11 | 0.009 |
| B | 0.15 | 21.9 | 18.8 | 1.8 | 0.3 | 1.2 | 1.0 | 3.4 | 2.1 | 0.11 | 0.008 |
| C | 0.15 | 22.1 | 18.6 | 1.9 | 1.3 | 1.1 | 0.9 | 3.3 | 2.1 | 0.10 | 0.010 |
| D | 0.15 | 22.4 | 18.9 | 1.9 | 0.5 | 1.1 | 0.6 | 3.8 | 2.4 | 0.10 | 0.010 |
| E | 0.11 | 22.6 | 18.6 | 2.0 | 1.0 | 1.4 | — | 3.7 | 2.1 | 0.10 | 0.020 |

TABLE III

| Alloy No. | Heat-Treatment | Creep-Rupture Properties at 200 N/mm$^2$/870° C. | | Correlation Factor |
|---|---|---|---|---|
| | | Life (h) | Elong. (%) | |
| 1 | (a) | 2414 | 21.0 | 153 162 |
| 2 | (a) | 1807 | 26.3 | 153 781 |
| 3 | (b) | 2007 | 21.0 | 153 759 |
| 4 | (b) | 3021 | 45.2 | 153 478 |
| | | 2920 | 39.4 | |
| A | (a) | 1306 | 30.2 | 151 967 |
| B | (a) | 1284 | 15.8 | 152 055 |
| C | (a) | 1408 | 26.6 | 152 095 |
| D | (a) | 1691 | 26.3 | 152 329 |
| E | (c) | 1164 | 30.6 | — |

NOTES:
(a) 8 h/1160° C./AC.* + 4 h/900° C./AC + 16 h/760° C./AC.
(b) 8 h/1160° C./AC + 16 h/760° C./AC.
(c) 4 h/1160° C./AC + 16 h/850° C./AC.
*AC = Air-Cooled.

Hot-corrosion tests were carried out on an alloy according to the invention having the composition, in percent by weight (Alloy 5)

C 0.15; Cr 22.0; Co 19.0; W 2.0; Nb 0.8; Ta 1.1; Hf 0.7; Ti 3.6; Al 2.0; Zr 0.10; B 0.01; Ni Balance and on a specimen of IN-939 (Alloy E). Cylindrical test pieces machined from heat-treated castings of the alloys were exposed for 500 hours in a rig burning marine diesel fuel, at an air:fuel ratio of 30:1. Ditertiary butyl sulphide was added to raise the sulfur content of the fuel to 3% by weight, and ASTM sea salt was added to the hot gas stream at a concentration in air of 10 ppm. The specimens were heated at 704° C. and thermally cycled to room temperature using forced air cooling once every 24 hours. The depth of penetration of the corrosion from the surface of the specimens was then measured, and found to be as follows:

| Alloy No. | Average Penetration in Micrometers |
|---|---|
| 5 | 2.5, 7.5, 7.5, 5.0 (four specimens) |
| E | 38 |

Although the present invention has been described in conjunction with preferred embodiments, it is to be understood that modifications and variations may be resorted to without departing from the spirit and scope of the invention, as those skilled in the art will readily understand. Such modifications and variations are considered to be within the purview and scope of the invention and appended claims.

For example, although primarily intended for the production of castings, the alloys may also be useful in the wrought form, and if heat-treated in vacuum, they may be rapidly cooled after each stage of heating by gas fan quenching.

While in accordance with the provisions of the statute, there is illustrated and described herein specific embodiments of the invention. Those skilled in the art will understand that changes may be made in the form of the invention covered by the claims and that certain features of the invention may sometimes be used to advantage without a corresponding use of the other features.

The embodiments of the invention in which an exclusive property or privilege is claimed are defined as follows:

1. A nickel-chromium-cobalt alloy, consisting essentially, in percent by weight, of about 20 to about 23% chromium, about 17 to about 23% cobalt, about 1 to 2.5% tungsten, about 0 to about 0.5% molybdenum, about 0.4 to about 1.2% niobium, about 0.6 to about 1.4% tantalum, about 2.95 to about 3.85% titanium, about 1.6 to about 2.8% aluminum, about 0.3 to about 1.3% hafnium, about 0.005 to about 1% zirconium, about 0.001 to about 0.05% boron, and about 0.01 to about 0.25% carbon, the balance, apart from impurities, being nickel, wherein the contents of niobium, hafnium, titanium and aluminum are so correlated that they satisfy the expression (the Correlation Factor):

$$28327\ Nb+804\ Hf+36956\ Ti+115057\ Al-6676\ Nb^2-564\ Hf^2-4847\ Ti^2-54349\ Al^2+8392\ Al^3-5255\ (Nb\times Ti)\geqq 153\ 123.$$

2. An alloy according to claim 1 in which the carbon content is from 0.05 to 0.20%, the zirconium content is from 0.005 to 0.15% and the boron content is from 0.002 to 0.02%.

3. An alloy according to claim 1 or claim 2 in which the value of the Correlation Factor is at least 153 223.

4. An alloy according to claim 1 that contains about 22% chromium, about 19% cobalt, about 2% tungsten, about 1.1% tantalum, about 3.4% titanium, about 0.8% niobium, about 0.7% hafnium, about 2% aluminum, about 0.15% carbon, about 0.1% zirconium, and about 0.01% boron, the balance, apart from impurities, being nickel.

5. A directionally-solidified casting made from an alloy according to claim 1.

* * * * *